US006397617B1

(12) United States Patent
Johnson

(10) Patent No.: US 6,397,617 B1
(45) Date of Patent: Jun. 4, 2002

(54) PROTECTIVE COVER FOR AIR CONDITIONING UNIT

(76) Inventor: Shannon Wayne Johnson, 1229 Choyce Ave., Charlotte, NC (US) 28217

( * ) Notice: Subject to any disclaimer, the term of this patent is extended or adjusted under 35 U.S.C. 154(b) by 0 days.

(21) Appl. No.: 09/668,520

(22) Filed: Sep. 22, 2000

(51) Int. Cl.[7] ..... F25D 23/12; E05C 21/02

(52) U.S. Cl. ..... 62/259.1; 49/465

(58) Field of Search ..... 62/259.1, 262, 62/265; 49/463, 464, 465, 50, 57, 478.1; 454/347; 52/507, 202

(56) References Cited

U.S. PATENT DOCUMENTS

| | | | | |
|---|---|---|---|---|
| 2,639,751 A | * | 5/1953 | Flaherty | |
| 3,831,321 A | * | 8/1974 | Johnson | 49/463 |
| 4,389,827 A | * | 6/1983 | Van Valkenburg | 52/202 X |
| 4,686,893 A | | 8/1987 | Jinkins | |
| 4,745,769 A | | 5/1988 | Wooden, Jr. | |
| 4,887,861 A | * | 12/1989 | Moch et al. | |
| 4,953,328 A | | 9/1990 | Sewell et al. | |
| 5,097,678 A | | 3/1992 | Aubuchon | |
| 5,158,486 A | | 10/1992 | Tamame | |
| 5,226,264 A | | 7/1993 | Walters | |
| 5,307,849 A | | 5/1994 | Nelson | |
| 5,660,054 A | | 8/1997 | Rice | |
| 6,103,974 A | * | 8/2000 | Erdfarb | |

FOREIGN PATENT DOCUMENTS

JP 10054587 A * 2/1998

* cited by examiner

*Primary Examiner*—Denise L. Esquivel
*Assistant Examiner*—Chen-Wen Jiang
(74) *Attorney, Agent, or Firm*—Dougherty & Clements LLP

(57) ABSTRACT

A protective cover for preventing the entry of debris into an outdoor air conditioning unit while providing for the safe operation of the unit in the event of unintentional activation of the unit while the invented apparatus is installed. During normal operation, the invented protective air conditioning cover provides a covering for the top surface of an outdoor air conditioning unit, including the fan discharge opening, which is usually covered by a metallic grate. The protective cover is held in place on top of the unit by magnets. The placement of the magnets and the types of magnets used in the invented cover are designed to provide just enough attraction between the magnets and the metallic surface of the air conditioning unit that the invented cover is maintained in position upon the top of the unit during normal weather conditions, and all but the most extreme wind conditions. However, the upward pressure caused by operation of the fan motor within the air conditioning unit is capable of lifting the invented cover with enough force to remove the magnetically connected cover from the top of the air conditioning unit. The apparatus consists of a flat layer of material having magnets evenly spaced about its periphery. The cover material is light weight so that it may be lifted upward by the air conditioning unit fan, but durable enough so as not to be punctured by limbs and other debris which typically fall upon an outdoor air conditioning unit.

16 Claims, 2 Drawing Sheets

PROTECTIVE COVER FOR AIR CONDITIONING UNIT

FIELD OF THE INVENTION

The present invention relates to a method and apparatus for protecting an outdoor air conditioning unit, and more particularly to apparatus and methods for production of a covering for protecting an outdoor air conditioning unit from damage by the elements, such covering being releasable from the air conditioning unit in the event of accidental operation of the unit.

1. Background of the Invention

Most modern day residential and commercial structures have central heat and air conditioning. The most common arrangement for the air conditioning portion of a central heat and air conditioning system is to have a mechanism for throttling of a coolant and heat exchange within the structure, and to have a compressor housed outside of the structure. In such an arrangement, coolant is compressed by the outdoor compressor and transported inside the structure with metallic tubing. Once inside, the coolant is allowed to decompress, which causes a decrease in the temperature of the coolant. A fan then blows inside air over the metallic tubes which contain the decompressed coolant, thus cooling the air. The cooled air is then circulated about the structure.

While compressing the coolant, the outside compressor produces undesirable heat. This heat is typically removed by a fan which blows outside air over the outdoor coolant tubing and compressor in order to get rid of the excess heat. Most typically, the fans exhaust the outside air out of the top of an outdoor compressor unit through an opening called the fan discharge opening.

Maintenance issues involving the outdoor unit arise when the outdoor unit is not in consistent use, such as in the winter months when air conditioning is not needed. During such periods of non-use, debris such as dirt, dust, limbs, leaves, and other objects from the environment may enter the outdoor unit through the discharge opening on top of the unit. These objects may damage the unit over time.

It is desirable to cover the outdoor unit during periods of non-use so that debris cannot enter the outdoor unit. Several types of covers have been introduced which fasten around outdoor units in order to protect them from the elements. However, danger occurs if the outdoor unit is unintentionally operated when a cover is installed. If the fan in an outdoor unit is activated while a cover is installed, the cover may prevent proper ventilation from occurring, thus causing the compressor to overheat. Further, back-pressure upon the fan caused by the blockage of the discharge opening by the cover may cause the fan motor to overheat and/or fail.

What is needed is an apparatus for covering an outdoor air conditioning unit and protecting the unit from outside debris, while at the same time protecting against the dangers associated with unintentionally operating the air conditioning unit with the cover in place.

2. Description of the Art

Applicant is aware of the following U.S. Patents concerning protective covers for an air conditioning unit.

| U.S. Pat. No. | Inventor | Issue Date | Title |
|---|---|---|---|
| 3,831,321 | Johnson | 08-27-1974 | AIR CONDITIONER COVERS |
| 4,686,893 | Jinkins | 08-18-1987 | COVER ASSEMBLY FOR AN AIR MOVING DEVICE |

-continued

| U.S. Pat. No. | Inventor | Issue Date | Title |
|---|---|---|---|
| 4,745,769 | Wooden, Jr. | 05-24-1988 | CENTRAL AIR CONDITIONER COVER APPARATUS |
| 4,953,328 | Sewell | 09-04-1990 | AIR CONDITIONING COMPRESSOR SECTIONALIZED COVER |
| 5,097,678 | Aubuchon | 03-24-1992 | VENTILATING PROTECTIVE COVER FOR TOP-DISCHARGE AIR CONDITIONERS |
| 5,158,486 | Tamame | 10-27-1992 | DEBRIS AND WEATHER PROTECTOR FOR AIR CONDITIONAL COMPRESSOR CABINETS |
| 5,226,264 | Walters | 07-13-1993 | PORTABLE SHELTER FOR AIR |
| 5,307,849 | Nelson | 05-03-1994 | AIR CONDITIONER COVER |
| 5,660,054 | Rice | 08-26-1997 | CONDENSING UNIT ENCLOSURE |

SUMMARY OF THE INVENTION

The invention provides a protective cover for preventing the entry of debris into an outdoor air conditioning unit while providing for the safe operation of the unit in the event of unintentional activation of the unit while the invented apparatus is installed.

During normal operation, the invented protective air conditioning cover provides a covering for the top surface of an outdoor air conditioning unit, including the discharge opening, which is usually covered by a metallic grate. The protective cover is held in place on top of the unit by one or more magnets. The magnets are arranged around the periphery of the cover, and are of sufficient strength to hold the cover in place during significant wind bursts.

The placement of the magnets and the types of magnets used in the invented cover are configured to provide just enough attraction between the magnets and the metallic surface of the air conditioning unit that the invented cover is maintained in position upon the top of the unit during normal weather conditions, and all but the most extreme wind conditions. However, the upward pressure caused by operation of the fan motor within the air conditioning unit is capable of lifting the invented cover with enough force to remove the magnetically connected cover from the top of the air conditioning unit. Removal of the cover in the event of accidental operation of the air conditioning unit prevents over heating of the air conditioning components and fan motor due to a blocked discharge opening. The use of magnets allows the cover to be attached to the air conditioning unit without the use of rope, chain, adhesive material, or other mechanical attachment means.

The present invention is particularly useful for covering outdoor units during periods of extreme weather conditions or when the outdoor unit is not used for lengthy periods of time, such as during the winter months.

The apparatus consists of a general flat layer of material having magnets evenly spaced about the underside of its periphery. The cover material is light weight so that it may be lifted upward by the air conditioning unit fan, but durable enough to resist punctures by limbs and other debris which typically fall upon an outdoor air conditioning unit. The material need not be completely impermeable to water or air, but must consist of a barrier material capable of preventing all but a small quantity of rain and dust from entering the top of the unit (water repellant and air resistant), and must consist of a barrier material capable of resisting the flow of air to such a degree that a high pressure area under the cover is produced upon operation of the unit fan.

OBJECTS OF THE INVENTION

The principal object of the present invention is to provide an improved protective cover for an air conditioning unit.

A further object of this invention is to provide an improved protective cover for an air conditioning unit which is easily installed upon the top surface of an outdoor air conditioning unit so as to prevent the entry of water and debris into the air conditioner.

Another object of the invention is to provide apparatus for an improved protective cover for an air conditioning unit which is easily installed upon the top surface of an outdoor air conditioning unit so as to prevent the entry of all but a small quantity of water and debris into the air conditioner which will disconnect from the air conditioning unit upon accidental operation of the unit fan so as to prevent overheating of the unit.

BRIEF DESCRIPTION OF THE DRAWINGS

The foregoing and other objects will become more readily apparent by referring to the following detailed description and the appended drawings in which.

DETAILED DESCRIPTION

Figure 1:
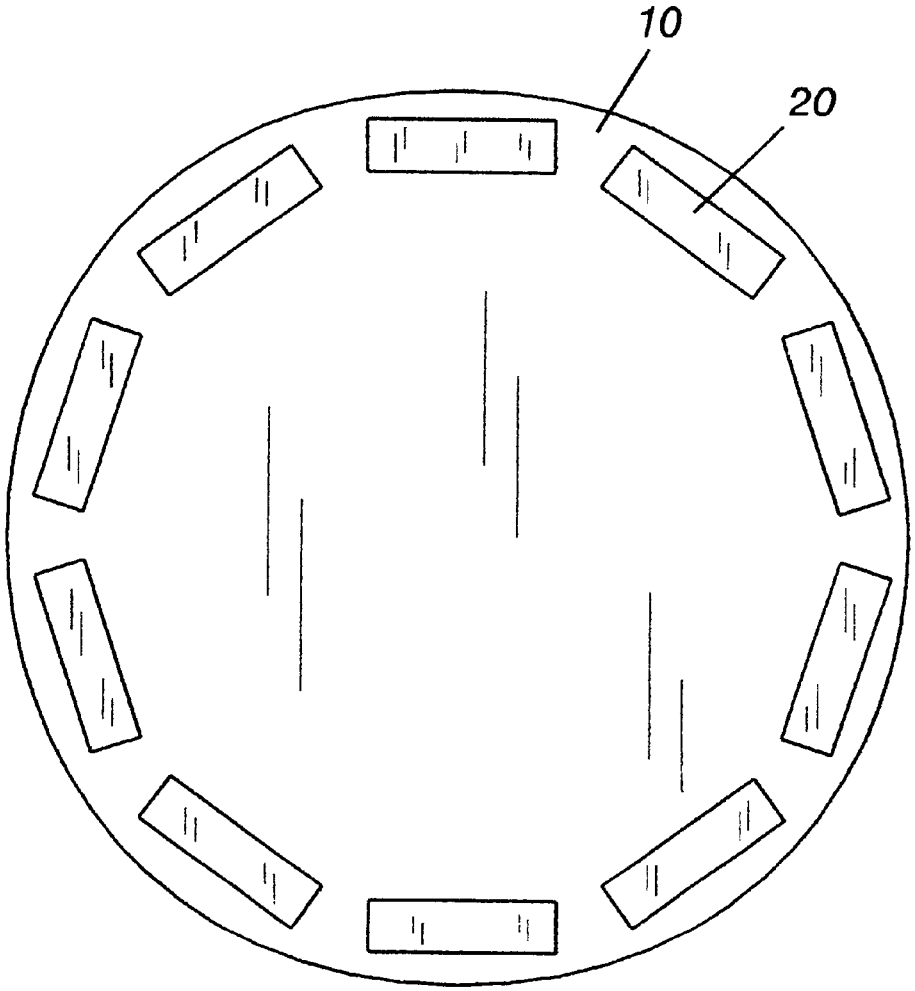
FIG. 1 is a bottom view of the invented protective cover.
Figure 2:
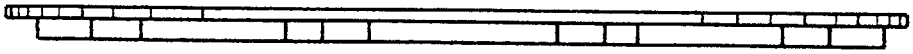
FIG. 2 is a side view of the invented protective cover of FIG. 1.

Referring now to the drawings, and particularly to FIGS. 1 and 2, the invented protective cover for an air conditioning unit includes a protective panel 10 and at least one magnet 20.

The panel 10 is a substantially flat piece of material. The panel 10 is cut or formed to the approximate dimensions of the fan discharge opening of the top surface of the outdoor air conditioning unit to be covered. For instance, if the panel is used with an air conditioning unit having a circular fan discharge opening, the panel 10 is a flat, circular piece of material having a circumference slightly larger than the discharge opening of the air conditioning unit.

The panel 10 is made from a lightweight material. The panel 10 is preferably made from a UV resistant rubber material which is weather resistant and capable of withstanding light to moderate impacts, so as to protect the air conditioning unit from falling limbs and other debris. The panel 10 may also be made from a weather resistant polymer. The preferred polymer material is PVC.

Alternatively, the panel 10 is shaped to fit around a projecting discharge opening grate. In many models of air conditioner, the fan is covered by a grate which extends upwardly, above the top surface of the air conditioning unit. In these situations, the panel 10 is shaped to accommodate the grate by simply forming the panel 10 in a shape that corresponds to the shape of the grate. The magnets 20 are always placed in a location which may contact the flat metallic surfaces of the unit.

The magnets 20 may be any of several available types of magnets. The magnets are preferably fixedly attached to and evenly spaced on the bottom side of the panel 10 about the periphery of the panel 10. The magnets 20 are preferably spaced along the edge of the panel 10 because the flat surface, if any, of the top of an outdoor air conditioning unit is typically located around the outer edge of that top section. Alternative arrangements of magnets 20 may be used to fit different configurations of air conditioning units. It is understood that the magnets 20 should not project outwardly from the surface of the panel 10 to any great extent, as this would create an undesirable gap between the panel 10 and the top surface of the air conditioning unit, allowing air to flow freely into and out of the unit even when the cover was installed upon the unit.

In use, the invented protective cover is placed upon the top of an air conditioning unit, magnet-side down. The magnets 20 are secured to the metallic top portion of the unit by magnetic attraction. The panel 10 is held in contact with the top of the unit, covering the fan discharge opening, and protecting the unit from damage by water, limbs, and debris. Strength, number, and positioning of the magnets 20 upon the panel 10 is determined by the size and shape of the fan discharge opening and the top surface of the unit such that the cover will remain securely attached to the unit in the event of wind, rain, and other elements of the weather and environment.

The strength, number, and positioning of the magnets 20 is such that the cover will remain attached to the unit during foul weather, but will release from the unit upon activation of the compressor fan within the outdoor unit. If activated, the fan will generate considerable upward pressure upon the cover. This upward pressure is enough to break the magnetic seal between the surface of the unit and the magnets 20 in the cover. After the magnets 20 have been broken from the top of the unit, the cover gently glides off of the top of the unit so that the operating unit may continue to operate without the top discharge opening being obstructed.

The cover may then be used over and over again, indefinitely. The cover is simply replaced on the deactivated unit by laying the cover, magnet-side down, upon the outdoor unit.

First Alternative Embodiment

Figure 3:
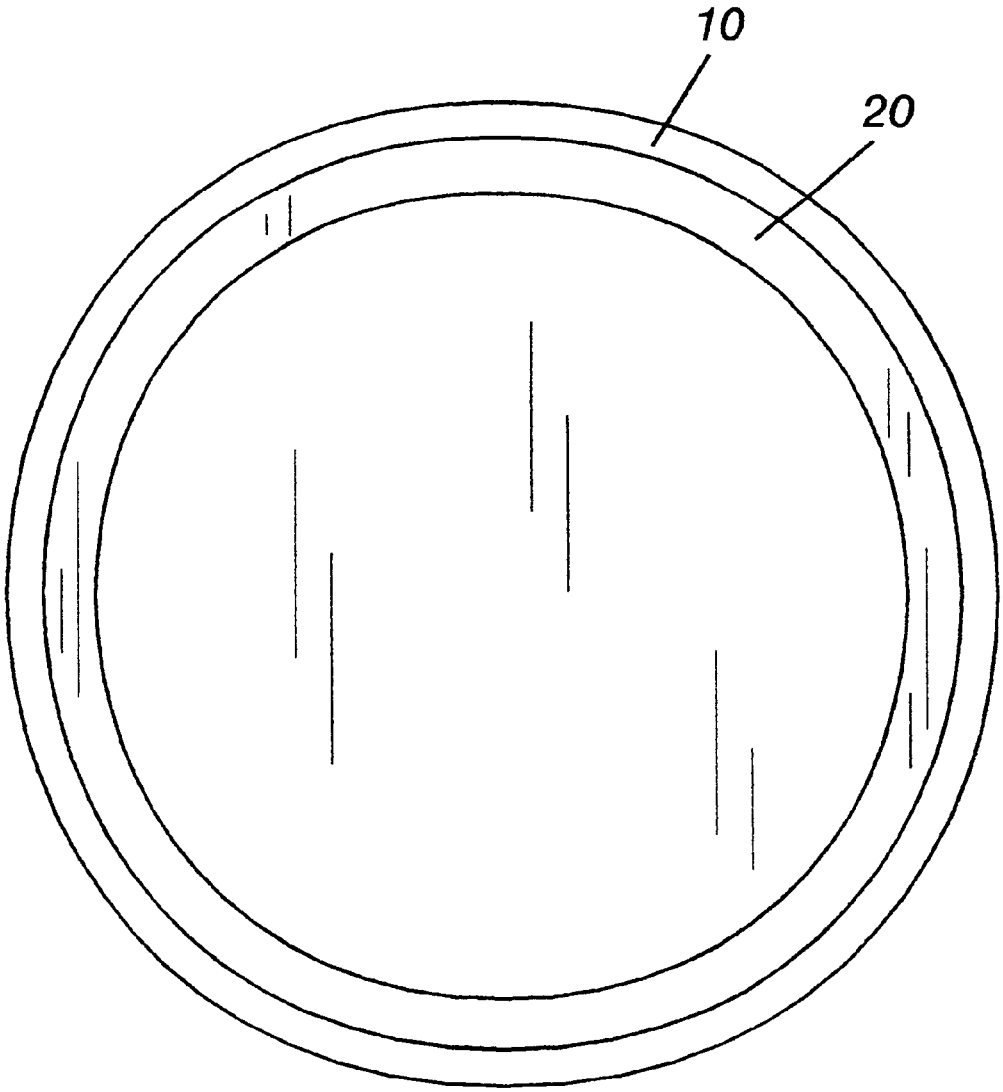
FIG. 3 is a bottom view of an alternative embodiment of the invented protective cover.
Figure 4:
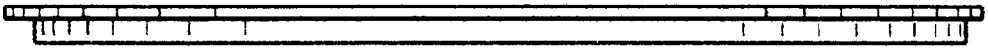
FIG. 4 is a side view of the alternative embodiment of the invented protective cover of FIG. 3.

Referring now to the drawings, and particularly to FIGS. 3 and 4, the first alternative embodiment of the invented protective cover for an air conditioning unit includes a protective panel 10 and an annular magnet 20.

The panel 10 is a substantially flat piece of material. The panel 10 is cut or formed to the approximate dimensions of the fan discharge opening of the top surface of the outdoor air conditioning unit to be covered. For instance, if the panel is used with an air conditioning unit having a circular discharge opening, the panel 10 is a flat, circular piece of material having a circumference slightly greater than the outer circumference of the discharge opening of the air conditioning unit.

The panel 10 is made from a lightweight material, preferably from a UV resistant rubber material which is weather resistant and capable of withstanding light to moderate impacts, so as to protect the air conditioning unit from falling limbs and other debris. The panel 10 may also be made from a weather resistant polymer material. The preferred polymer material is PVC.

The magnet 20 is a singular annular magnet, preferably formed or cut from a flexible, polymeric, magnetic material.

The magnet is fixedly attached to the bottom side of the panel 10 about the periphery of the panel 10. The magnet is positioned along the edge of the panel 10 because the flat surface, if any, of the top of an outdoor air conditioning unit is typically located around the outer edge of the fan discharge opening. Alternatively, the singular magnet 20 may be formed or cut in the form of a rectangle, for convenient placement upon air conditioning units having rectangular upper discharge openings.

An advantage in utilizing a singular magnet 20 rather than a series of individual magnets for securing the panel 10 to an air conditioning unit is that no gaps or open air spaces exist between the panel 10 and the upper surface of the air conditioning unit, as is the case when a series of individual magnets are used. Since the single annular or rectangular magnet 20 is attached to the bottom side of the panel 10 about its periphery, and since the entire magnet 20 abuts the top surface of the air conditioning unit when installed, the top surface of the air conditioning unit is practically sealed from the environment, preventing entry of all but a nominal amount of water and debris.

Second Alternative Embodiment

The second alternative embodiment of the invented protective cover for an air conditioning unit (not shown) includes a protective panel 10 in which the panel 10 itself is made of magnetic material.

The panel 10 is a substantially flat piece of material. The panel 10 is cut or formed to the approximate dimensions of the fan discharge opening of the top surface of the outdoor air conditioning unit to be covered. For instance, if the panel is used with an air conditioning unit having a circular discharge opening, the panel 10 is a flat, circular piece of material having a circumference of the discharge opening of the air conditioning unit.

The panel 10 is made from a lightweight magnetic material. Preferably, the panel 10 is made from a flexible, polymeric, magnetic material. The panel 10 may be laminated or otherwise layered with a UV resistant rubber layer or a second polymeric layer for increased structural stability and UV resistance.

In use, the protective cover is magnetically attached to the area surrounding the discharge opening of the air conditioning unit as well as to the metallic grate, if any, covering the discharge opening.

EXAMPLE

By way of example, and not of limitation, the following example is described. An embodiment of the present invention consists of a ¼ inch thick, 24 inch diameter PVC panel having sixteen evenly spaced ¾ inch×1½ inch industrial magnets evenly spaced about and around the bottom surface of such panel.

The example cover mates with and is firmly attached to a standard circular residential outdoor air conditioning unit with enough attraction between the magnets and the metallic frame of the unit to hold the cover firmly in place through adverse weather conditions. However, upon activation of the fan within the outdoor unit, the cover is immediately disconnected from the unit and blown away from the discharge opening of the unit.

SUMMARY OF THE ACHIEVEMENT OF THE OBJECTS OF THE INVENTION

From the foregoing, it is readily apparent that I have invented an improved protective cover for an air conditioning unit. Further, it is readily apparent that I have invented an improved protective cover for an air conditioning unit which is easily installed upon the top surface of an outdoor air conditioning unit so as to prevent the entry of water and debris into the air conditioner. Further, it is readily apparent that I have invented an improved protective cover for an air conditioning unit which is easily installed upon the top surface of an outdoor air conditioning unit so as to prevent the entry of water and debris into the air conditioner which will disconnect from the air conditioning unit upon accidental operation of the unit fan so as to prevent overheating of the unit.

It is to be understood that the foregoing description and specific embodiments are merely illustrative of the best mode of the invention and the principles thereof, and that various modifications and additions may be made to the apparatus by those skilled in the art, without departing from the spirit and scope of this invention, which is therefore understood to be limited only by the scope of the appended claims.

What is claimed is:

1. In combination, an outdoor air conditioning unit having a protective cover, comprising:

a lightweight substantially flat panel formed from a water resistant and air resistant flexible material, said panel having an upper surface and a lower surface; and at least one minimally projecting magnet fixedly attached to said panel about the periphery of said lower surface of said panel;

wherein said protective cover is immediately disconnected and blown away when the outdoor air conditioning unit is activated.

2. A protective cover according to claim 1, wherein said panel is formed from a UV resistant rubber material.

3. A protective cover according to claim 1, wherein said panel is formed from a weather resistant polymer material.

4. A protective cover according to claim 1, wherein said panel is circular.

5. A protective cover according to claim 1, wherein said panel is flat.

6. A protective cover according to claim 1, wherein said panel has a first portion which is flat and a second portion which extends above said first portion;

wherein said at least one magnet is fixedly attached to said first portion; and whereby said second portion corresponds to an extending component of the fan discharge opening on the air conditioning unit to be covered such that the protective cover corresponds to the shape of the fan discharge opening on the top surface of the air conditioning unit.

7. A protective cover according to claim 1, wherein said magnet is a single magnet formed from a flexible, magnetic, polymeric material.

8. A protective cover according to claim 7 wherein said magnet is annular.

9. A protective cover according to claim 7, wherein said magnet is in the shape of a rectangle.

10. A protective cover according to claim 1, wherein said at least one magnet comprises a plurality of magnets spaced about said lower surface periphery.

11. In combination, an outdoor air conditioning unit having a protective cover, comprising:

a lightweight substantially flat panel formed from a water resistant, air resistant, and magnetic flexible material, said panel having an upper surface and a magnetic lower surface, wherein said protective cover is immediately disconnected and blown away when the outdoor air conditioning unit is activated.

12. A protective cover according to claim 11, wherein the panel is formed from a flexible, magnetic polymer material.

13. A protective cover according to claim 11, further comprising a UV resistant rubber layer laminated onto said upper surface of said panel.

14. A protective cover according to claim 11, further comprising a weather resistant flexible polymer layer laminated onto said upper surface of said panel.

15. A protective cover according to claim 11, wherein said panel is circular.

16. A protective cover according to claim 11, wherein said panel is flat.

* * * * *